US006581209B2

(12) United States Patent
Bramhan

(10) Patent No.: US 6,581,209 B2
(45) Date of Patent: Jun. 24, 2003

(54) NURSING GARMENT FOR USE WITH OUTERWEAR

(76) Inventor: Catherine D. Bramhan, P.O. Box 3328, Shelby, NC (US) 28151

( * ) Notice: Subject to any disclaimer, the term of this patent is extended or adjusted under 35 U.S.C. 154(b) by 0 days.

(21) Appl. No.: 09/877,764

(22) Filed: Jun. 11, 2001

(65) Prior Publication Data

US 2002/0184694 A1 Dec. 12, 2002

(51) Int. Cl.[7] ..... A41D 1/20
(52) U.S. Cl. ..... 2/48; 2/104
(58) Field of Search ..... 2/104, 102, 48, 2/46, 88

(56) References Cited

U.S. PATENT DOCUMENTS 621,761 A * 3/1899 Allen
4,106,122 A * 8/1978 Dodd ..... 2/104
4,566,136 A * 1/1986 Echols ..... 2/104
4,567,611 A * 2/1986 Kendrick ..... 2/104
4,601,068 A * 7/1986 Frechette ..... 2/104
4,631,754 A * 12/1986 Ryan ..... 2/104
4,651,349 A * 3/1987 Heiler ..... 2/104
4,660,227 A * 4/1987 Abramson ..... 2/104
4,713,842 A * 12/1987 Patterson ..... 2/104
4,797,953 A * 1/1989 Dameron ..... 2/104
4,924,528 A * 5/1990 Trombetti-Dickens ..... 2/104
D309,522 S * 7/1990 Merritt ..... D2/229
4,995,116 A * 2/1991 Beauchamp et al. ..... 2/104
5,086,517 A * 2/1992 Jones ..... 2/104
5,090,059 A * 2/1992 Kahl ..... 2/104
D359,838 S * 7/1995 Laseinde ..... D2/864
5,479,662 A * 1/1996 Runco ..... 2/104
6,327,712 B1 * 12/2001 Armstrong et al. ..... 2/104

* cited by examiner

*Primary Examiner*—John J. Calvert
*Assistant Examiner*—Alissa L. Hoey
(74) *Attorney, Agent, or Firm*—Clifton T. Hunt

(57) ABSTRACT

The nursing garment of this invention is in the nature of a bib, small enough to be easily carried with a baby's paraphernalia and easily positioned over a user's conventional outerwear when desired. The bib-like garment is preferably made from flannel into a body portion with a loop to pass over the head of a user, a panel that can be adjusted by the user to form either one or two openings for the breasts or to cover the breasts, as desired, and a second layer of privacy provided by at least one freely hanging flap extending over the panel. Reinforced edging extends around all sides of the garment.

6 Claims, 9 Drawing Sheets

NURSING GARMENT FOR USE WITH OUTERWEAR

FIELD OF THE INVENTION

This invention relates to women's apparel, and more specifically to a nursing bib for use with outerwear that provides the type of privacy a mother desires while she attends to the details of nursing her baby in a public setting.

BACKGROUND OF THE INVENTION

U.S. Pat. No. 4,797,953 for NURSING SHAWL issued Jan. 17, 1989 to Roger S. Dameron. Dameron's nursing shawl is intended to be used with conventional outerwear and is easily adaptable to provide privacy for a mother nursing her baby in a public place.

The nursing bib of this invention has the same attributes as Dameron's shawl, yet provides more of the privacy a mother desires, with dual layers of protection, while she prepares for nursing and nurses the baby in a public setting. After the nursing, the mother can easily remove the nursing bib from her dress or other outerwear she is wearing, pack it with the rest of the baby's paraphernalia, and do as she pleases. The nursing bib of this invention is clearly an improvement over Dameron.

As noted in the Dameron patent, the nursing garments in many prior patents are not suitable to be worn over the mother's clothes, restricting their use to the home. Alternatively, certain prior art nursing garments are designed as outerwear but they must be worn in lieu of more conventional outerwear. See, for example, U.S. Pat. No. 621,761; Pat. No. 4,106,122; Pat. No. 4,468,816; Pat. No. 4,567,611; and Pat. No. 4,601,068. See also the more recently issued U.S. Pat. No. 4,924,528, to Trombetti-Dickson, U.S. Pat. No. Des. 309,522 to Merritt, and U.S. Pat. No. Des. 359,838 to Laseinde.

None of the prior art patents relating to nursing garments provide the privacy and convenience of use in public that is provided by the nursing bib of this invention.

SUMMARY OF THE INVENTION

The nursing bib of this invention is small enough to be easily carried with a baby's paraphernalia and easily positioned over conventional outerwear, and removed, when desired. The nursing bib is available in different sizes for women of different sizes.

All sizes of the nursing bib are made alike, preferably from an easily handled fabric such as a tightly woven flannel. Each size includes three components: (1) a body portion, (2) a panel that the user can adjust to either form an opening for one breast or to cover the breasts, and (3) either one or two flaps hanging freely from the body portion and over the panel to provide a second layer of protection. The flap(s) provide privacy by hiding from the public the mother's adjustment of the panel to first expose a breast for nursing and to then adjust the panel to cover the breasts after the nursing. A loop extends from the body portion to be placed over the head and around the neck of a user before she nurses a baby.

DETAILED DESCRIPTION OF THE INVENTION

Figure 1:
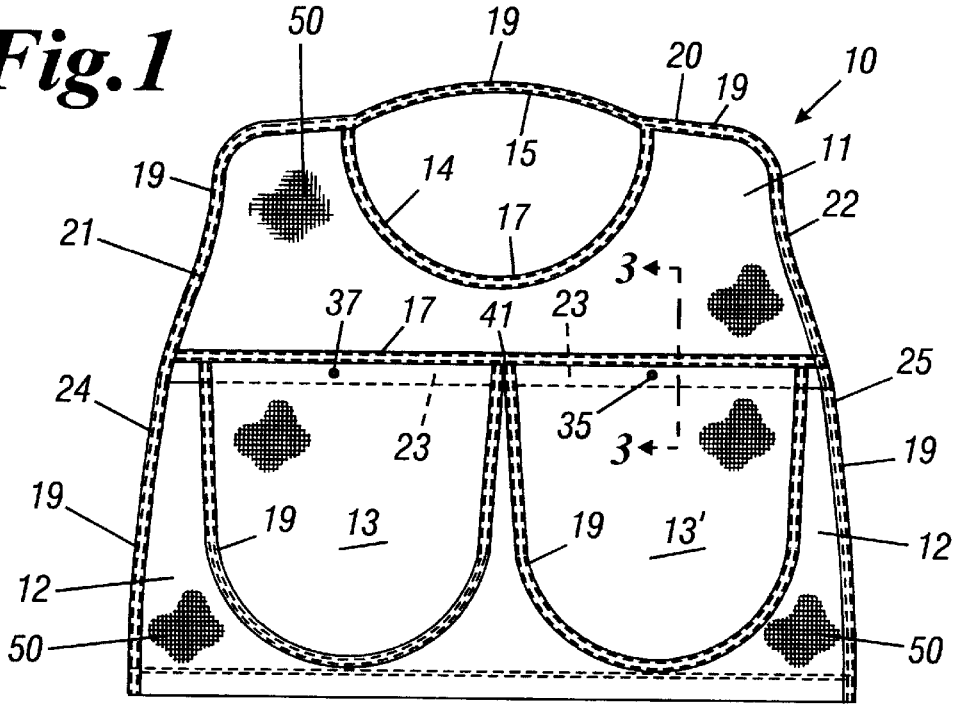
FIG. 1 is a front elevation of one embodiment of the nursing garment.
Figure 2:
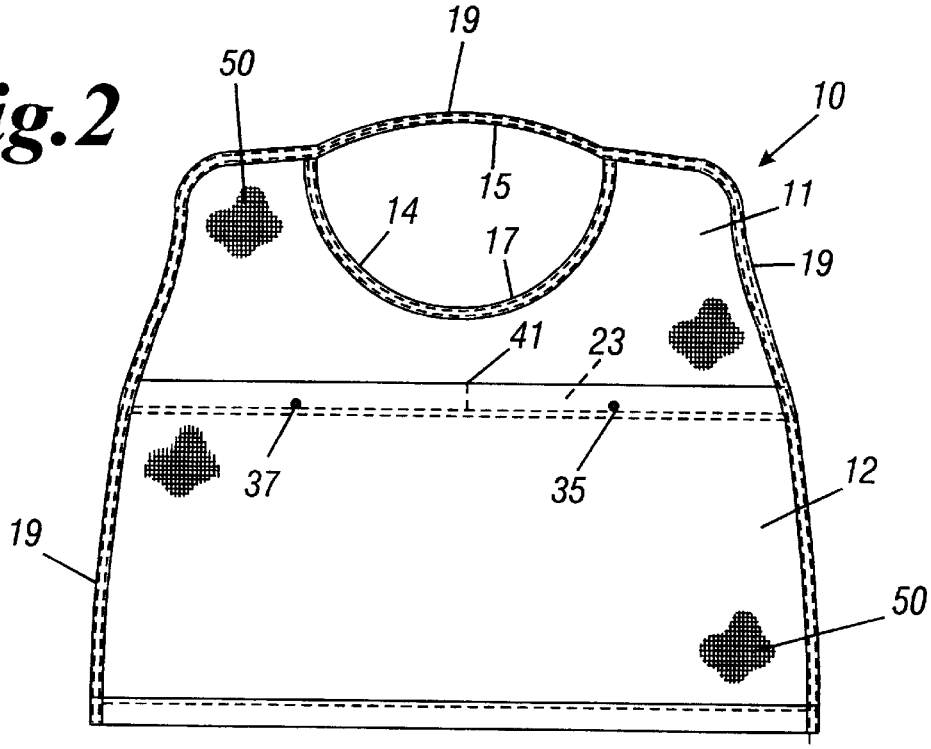
FIG. 2 is a rear elevation of the bib shown in FIG. 1.
Figure 4:
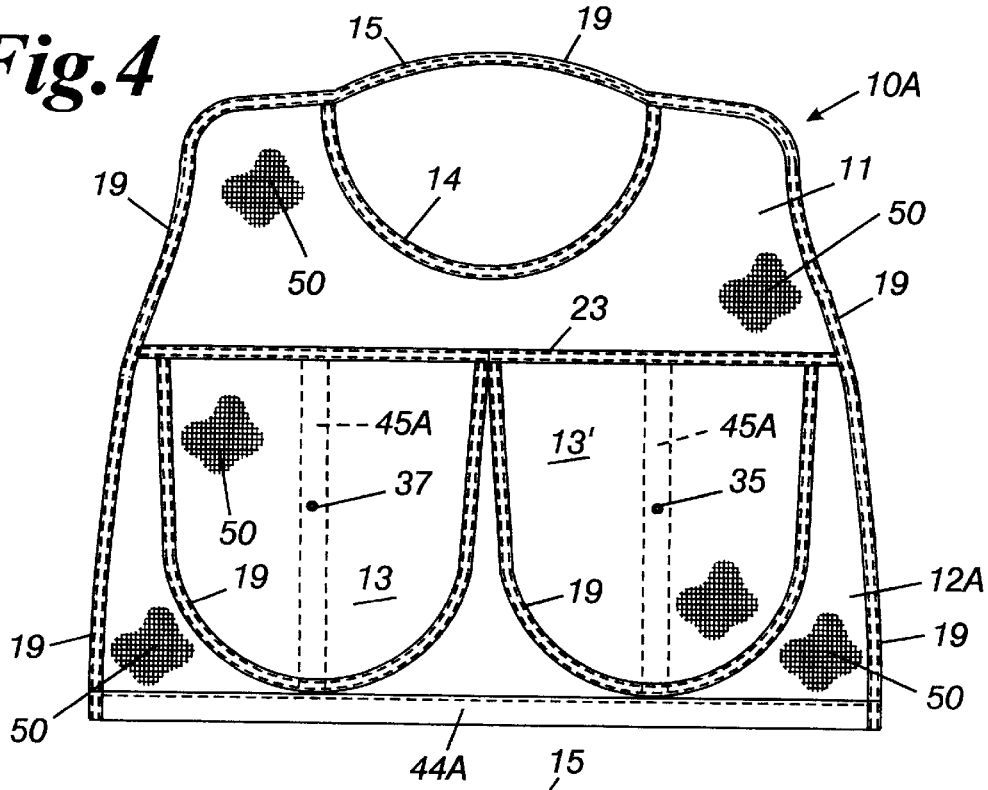
FIG. 4 is a front elevation of a second embodiment of the nursing bib.

Referring more specifically to the drawings, the nursing bib of FIG. 1 is broadly indicated at 10 and the nursing bib of FIG. 4 is broadly indicated at 10A.

THE EMBODIMENTS OF FIGS. 1 AND 4

Figure 6:
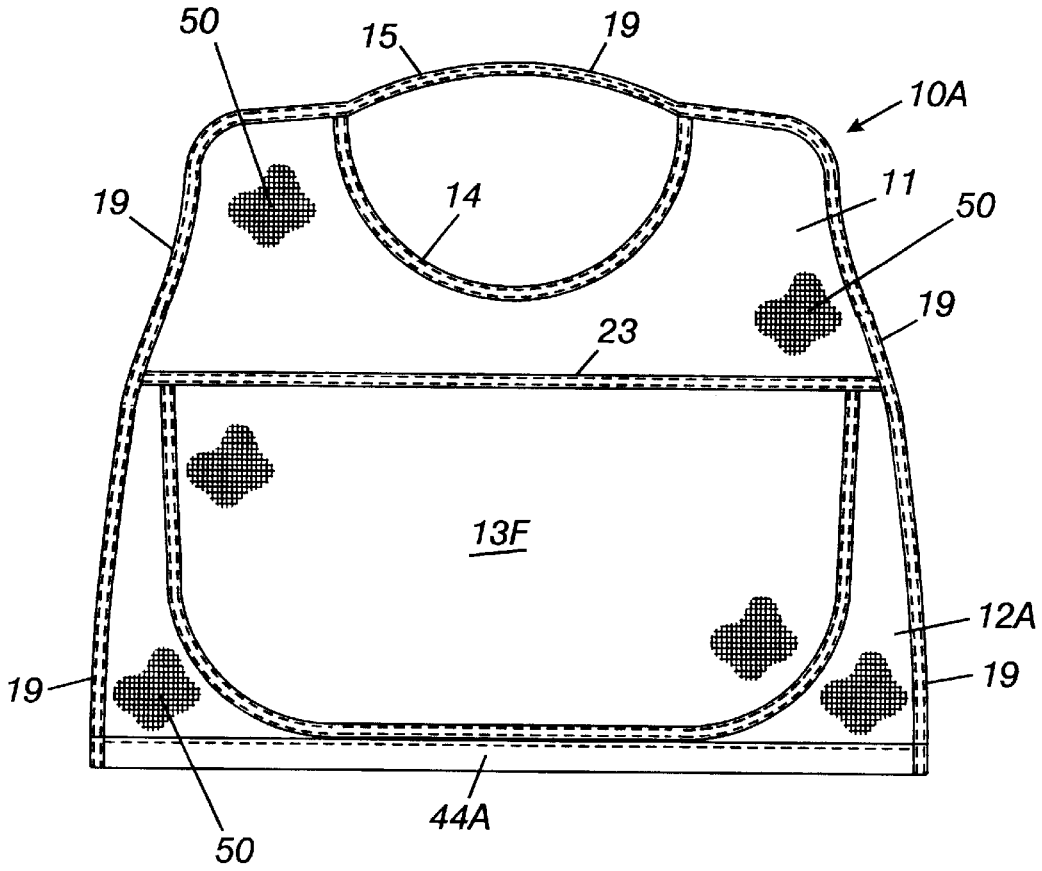
FIG. 6 is a front elevation like FIGS. 1 and 4, showing a single flap that can be used, instead of the two flaps, with either embodiment.

Each bib 10 and 10A is proportioned to effectively function for its intended purpose over conventional outerwear, and to be easily carried with a baby and its paraphernalia by a woman dressed in conventional outerwear and intending to nurse the baby while she is in a public area. Both of the bibs 10 and 10A include a body portion 11, a panel 12, and either two flaps 13 and 13$^1$ or a single flap 13F (FIG. 6). The single flap 13F may be used in lieu of the flaps 13 and 13$^1$. The flap 13F serves the same function as the two flaps, 13 and 13$^1$, providing another layer of protection, and may be preferred in some instances.

The body portion 11 is formed with a curved neckline 14 joined to a loop 15. The body portion 11 extends downwardly and laterally from the neckline 14 and is patterned to terminate at the top of the breasts and beneath the shoulders of the user. The body portion does not extend across the back of the user.

The loop 15 is formed of a folded strip of fabric 16 sewn together with a double row of stitches 17 and 18 (FIG. 3) to define reinforced edging 19. The portion of reinforced edging 19 comprising the loop 15 from the body portion to be placed over the head and around the neck of the user at appropriate times for nursing. The reinforced edging then extends along the upper edge 20 and side edges 21 and 22 of the body portion 11 and throughout the sides 24 and 25 of the panel 12. The reinforced edging 19 also extends along the upper ends of the flaps 13, 13$^1$ and of flap 13F, and connects the flaps to the hem 23 of the body portion 11. The reinforced edging 19 extends past the flaps to the reinforced edging 19 at the sides 21, 22 of the body portion 11. The reinforced edging functions as a strengthening agent and helps define the shape of the body portion 11, the panel 12, and the flaps 13, 13$^1$, and 13F.

The panels 12 (FIG. 1) and 12A (FIG. 4) are of planar configuration, and are adjustable to expose the breasts for nursing and to cover the breasts when desired. Each of the panels 12 and 12A extends downwardly from the body portion 11 to the lap of a seated user. The flaps 13, 13$^1$, and 13F hang freely from the hem 23 of the body portion 11 in overlying relation to the panel 12 and in overlying relation to the panel 12A. The flaps supplement the panels' coverage of the user's breasts.

Figure 9:
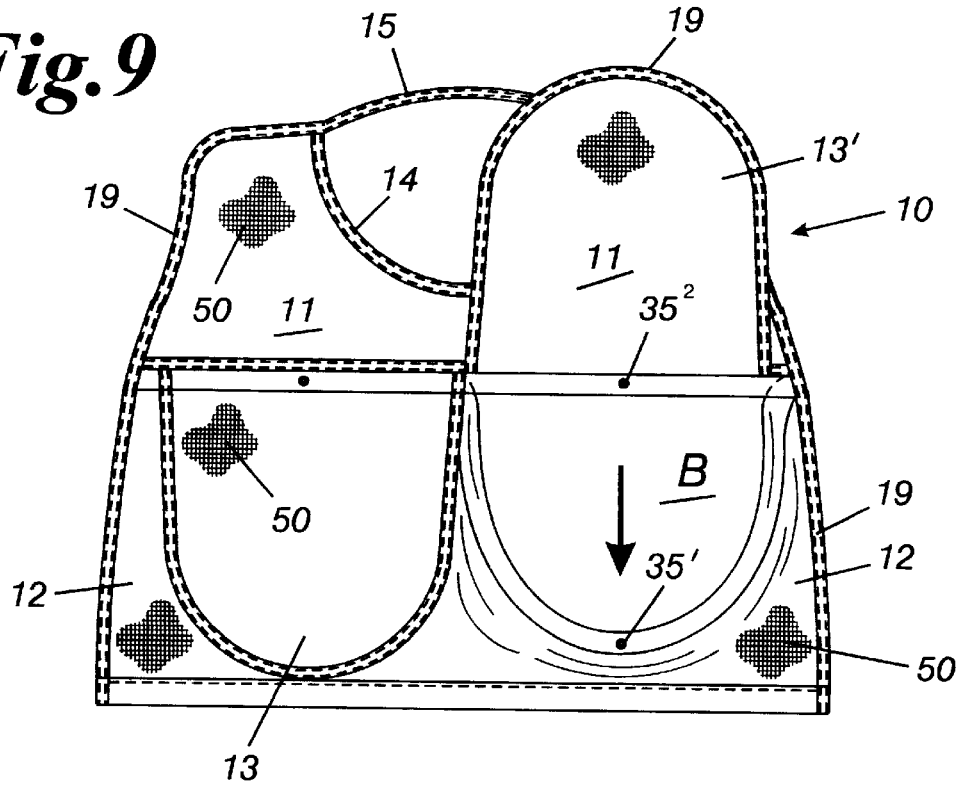
FIG. 9 is a front elevation of the bib of FIG. 1 with the panel opened as it is for nursing a baby and with one of the flaps raised to disclose the opened panel for illustration purposes only.
Figure 10:
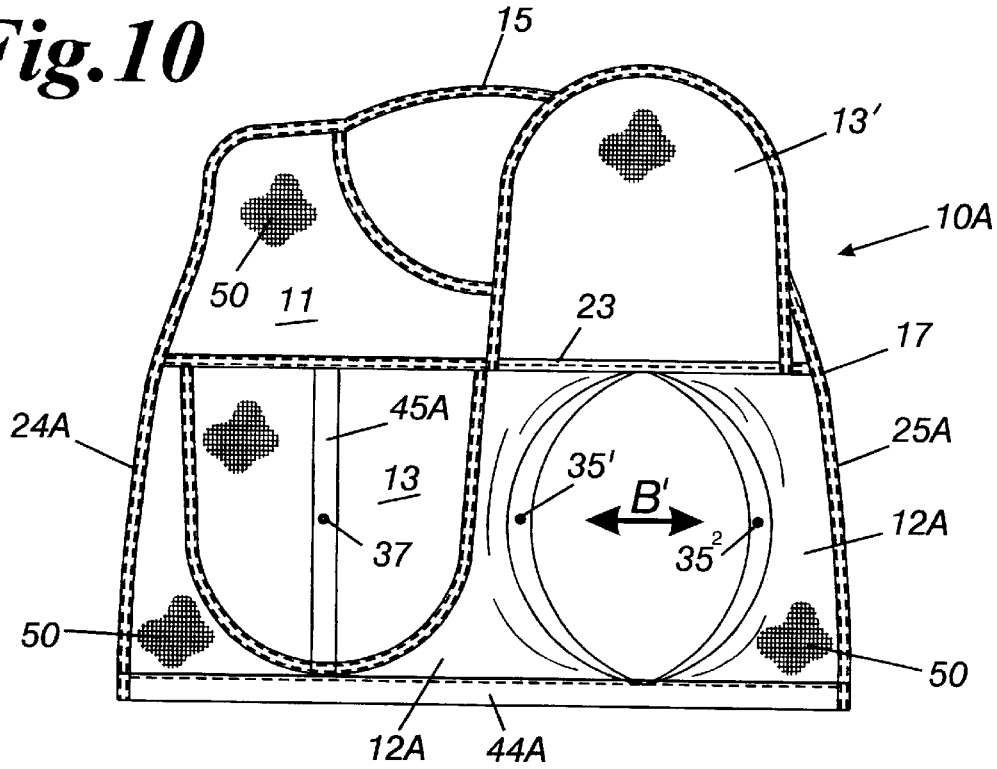
FIG. 10 is a front elevation of the bib of FIG. 4 with the panel opened as it is for nursing a baby and with one of the flaps raised to disclose the opened panel for illustration purposes only.

FIG. 9 illustrates the panel 12 adjusted to its open position and FIG. 10 illustrates the panel 12A adjusted to its open position. The flap 13$^1$ is raised in FIGS. 9 and 10 only for the purpose of illustration. It is intended that the flaps always remain lowered when the nursing garment is in actual use. The panels are adjusted to form or close openings by a mother's manipulation of manually operable fasteners 35 and 37 positioned to normally overlie the breasts of the user (FIGS. 1 and 4).

It is generally known that in order for babies to get the best nourishment, the first breast offered should be the same as the last one used in a nursing session. Nursing sessions are generally four or five hours apart and some mothers find it difficult to remember which breast was last used.

Figure 12:
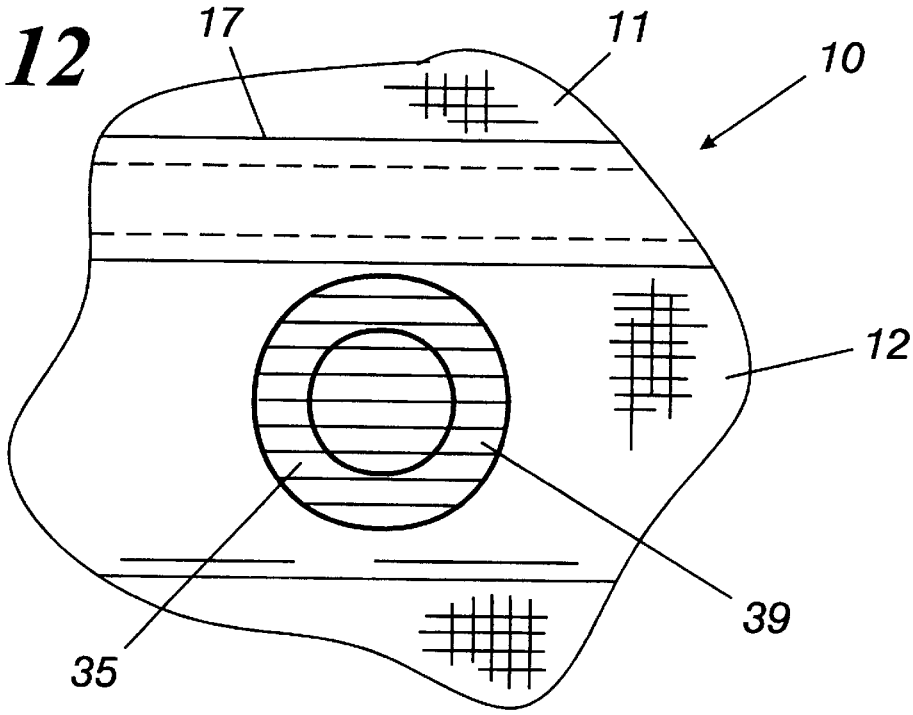
FIG. 12 is an exploded view of the snap fastener on the right side of the bib in FIG. 1.
Figure 13:
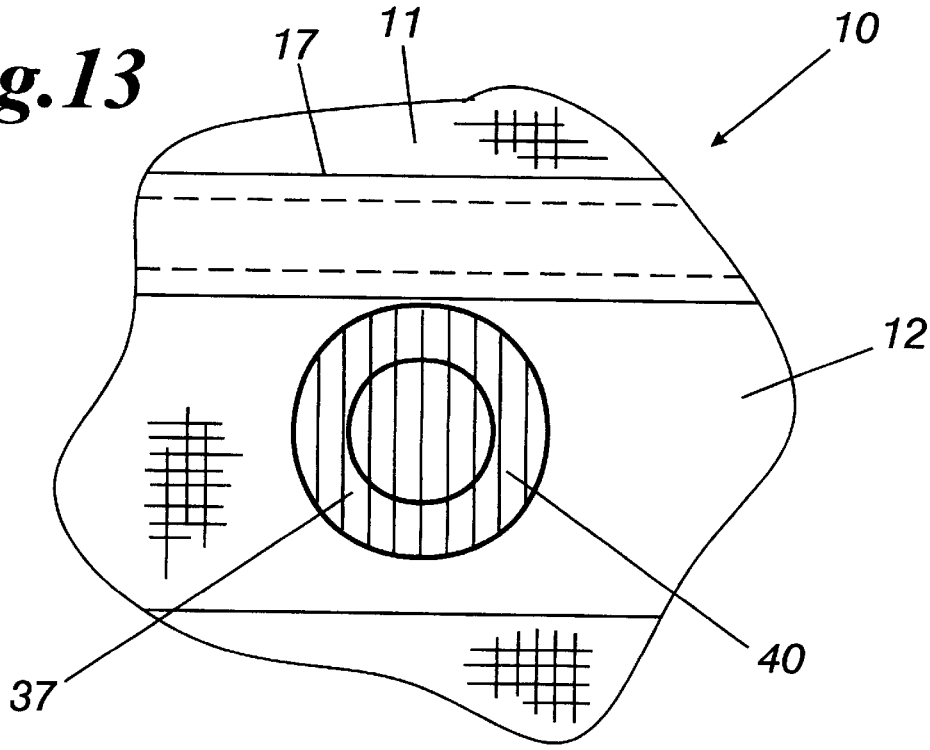
FIG. 13 is an exploded view of the snap fastener on the left side of the bib in FIG. 1.

As an aid to remembering which breast to first offer at a nursing session, the fastener 35 that overlies the left breast has a different color than the fastener 37 that overlies the right breast of the user. For example, FIG. 12 shows the fastener 35 with horizontal shading 39 indicating the color blue for the fastener over the left breast. FIG. 13 shows the fastener 37 with vertical shading 40 indicating that the fastener 37 over the right breast is red. Any colors can be used within the spirit of the invention.

THE EMBODIMENT OF FIG. 1

The panel 12 is permanently attached to only the ends of the body portion's hem 23 and to the mid-point 41 of the hem 23. Additionally, the panel 12 is releasably attached to the body portion intermediate the mid-point 41 of the hem 23 and the opposite ends of the hem 23, as indicated at 35 and 37 in FIG. 1.

Figure 3:
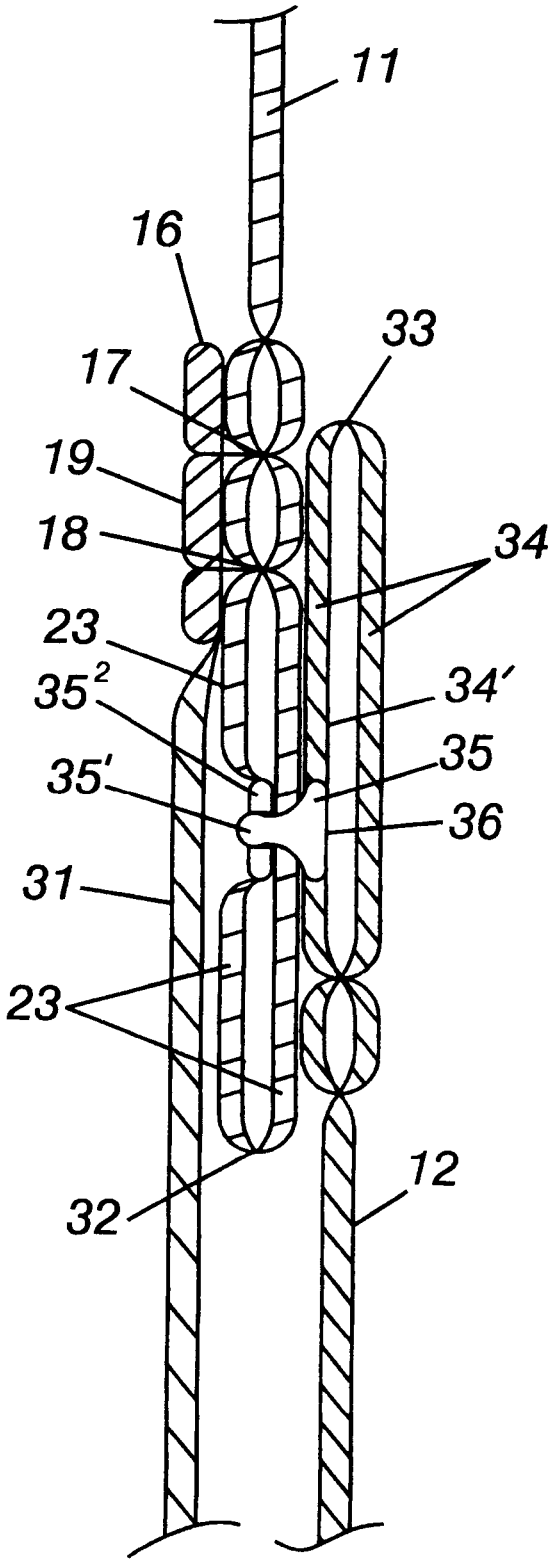
FIG. 3 is an enlarged sectional view taken substantially along the line 3—3 in FIG. 1.

The juncture of the panel 12 and the juncture of the flaps 13, 13$^1$ with the body portion 11 is illustrated in FIG. 3. As there indicated, the body portion 11 is folded on itself as at 32 to form the hem 23 at the lower edge of the body portion 11.

The upper end of the panel 12 is folded on itself as at 33 to form a hem 34. Manually operable fasteners releasably connect the upper end of the panel 12 to the body portion 11. In the illustrated embodiment, the male portion 35$^1$ of a snap fastener 35 is fixed to the inner surface 34$^1$ of the hem 34. The inner surface 34$^1$ of the panel's hem 34 lies against the hem 23 of the body portion 11. The female portion 35$^2$ of the snap fastener 35 is fixed to the hem 23 of the body portion 11 in mating relation with the male portion 35$^1$ of the snap fastener 35 on the hem 34 of the panel 12.

Similarly, but not shown in FIG. 3, a second snap fastener 37 is fixed to the panel's hem 34 and to the hem 23 of the body portion.

FIG. 9 illustrates the panel 12 after having been adjusted to form an opening B for the purpose of nursing. The opening B is formed after the male portion 35$^1$ of the snap fastener 35 is released from the female portion 35$^2$. With the snap fastener 35 opened, the panel 12 is unsupported between its mid-point 41 and the side 25 of the panel 12. The loosened portion of the panel may then be pulled down from the female portion 35$^2$ of the snap fastener 35 to form the opening B, as seen in FIG. 9. When nursing is finished the mother can reconnect the portions of the snap fastener 35 to close the opening within the privacy provided by the flap 13$^1$. The breast is then covered by the panel and, additionally, by the flap 13$^1$. The portion of the panel 12 beneath the flap 13 is opened and closed in the same manner.

Figure 7:
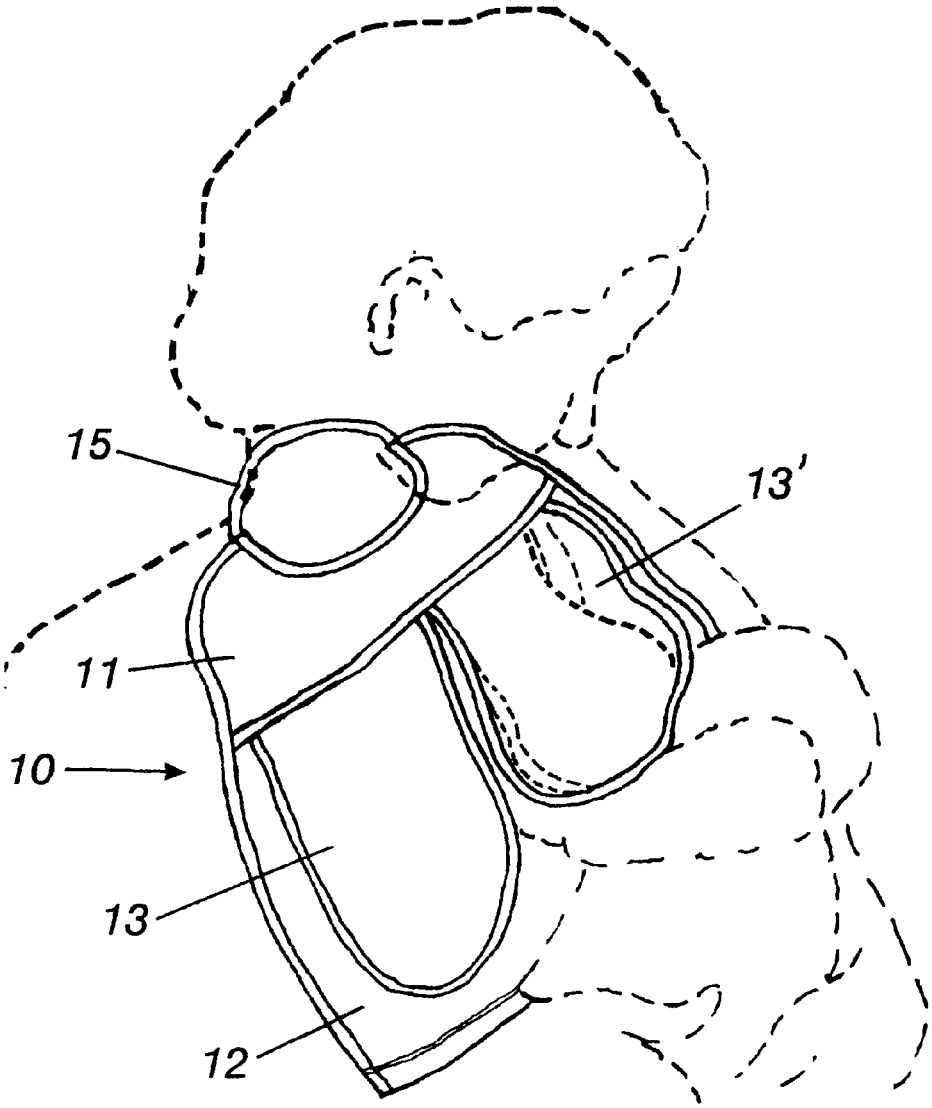
FIG. 7 is a perspective view showing the bib of FIG. 1 being used by a mother while nursing her child, the mother and child being shown in dotted lines.

FIG. 7 shows the nursing bib 10 in use while a mother is nursing her baby. It illustrates the privacy provided by the flap 13$^1$ while the panel 12 is opened.

Figure 11:
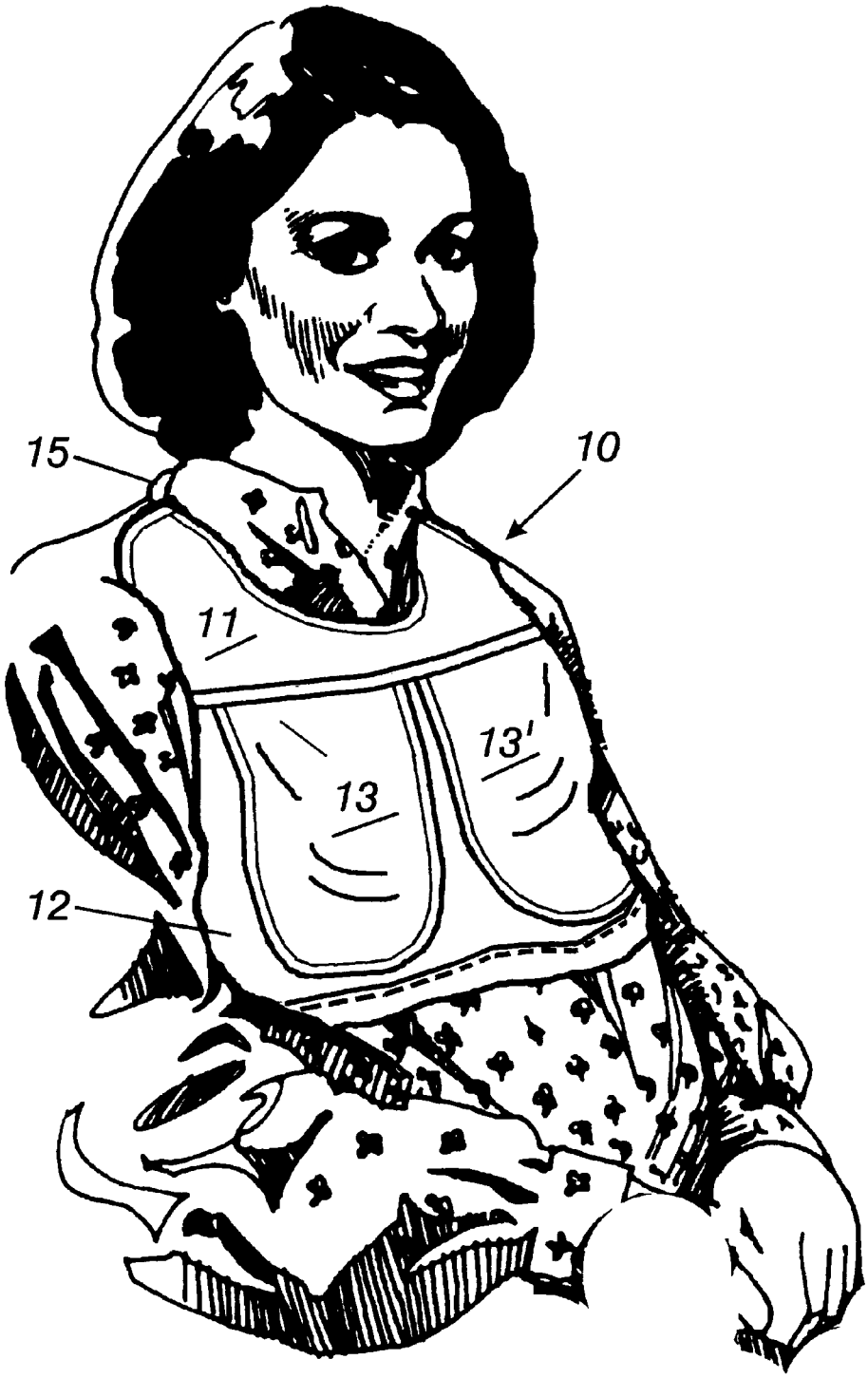
FIG. 11 is a perspective view of the nursing bib of this invention being worn over conventional outerwear.

FIG. 11 illustrates the nursing bib 10 as it appears when worn over conventional outerwear.

THE EMBODIMENT OF FIG. 4

The only difference between the embodiments of FIGS. 4 and 1 is in the structure and handling of the panel 12A to form the opening B$^1$ in FIG. 10.

Like the panel 12, panel 12A hangs down from the body portion 11 to the lap of a seated user, and panel 12A is the same width as the panel 12. But, unlike panel 12, panel 12A is permanently attached to hem 23 of the body portion throughout its width, from side 24A to side 25A of the panel 12A, preferably a distance of 18 to 24 inches.

Figure 5:
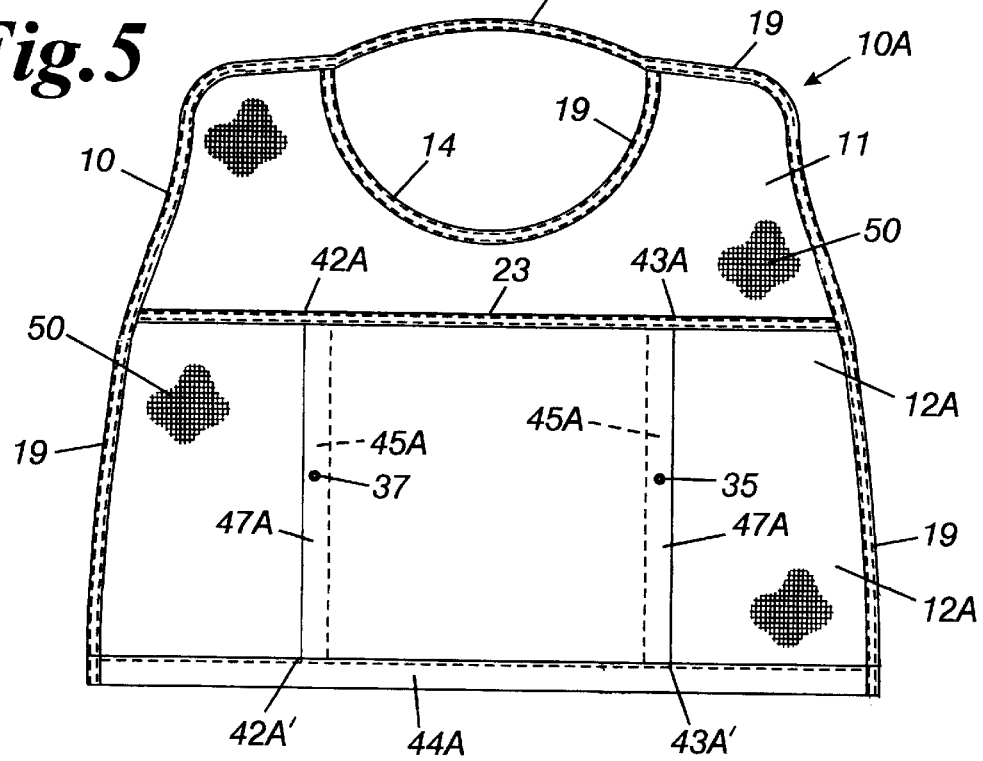
FIG. 5 is a rear elevation of the bib shown in FIG. 4.

Referring to FIGS. 4 and 5, two vertical lines of cut extend through the panel 12A. A first line of cut extends between the point 42A at the hem 23 of the body portion and the point 42A$^1$ at a hem 44A on the bottom of the panel. A second line of cut extends between a point 43A at the hem 23 of the body portion 11 and a point 43A$^1$ at the hem 44 on the panel 12A, preferably a distance of 8 to 12 inches. These two cuts in the panel 12A are positioned to be centered over the user's breasts when the garment 10 is worn.

A narrow strip of fabric 45A is sewn to the panel 12A along one side of each of the vertical cuts. Male portions of snap fasteners 35 and 37 are fastened to the fabric strips 45A and female portions of snap fasteners 35 and 37 are fastened to the overlapping portions 47A of the panel 12A.

Referring to FIG. 10, the opening B$^1$ in the panel 12A is obtained by the mother releasing the male portion 35$^1$ from the female portion 35$^2$ of the snap fastener 35, within the privacy provided by the flap 13$^1$. In actual use, the flap 13$^1$ will not be in the illustrative position of FIG. 10 but in its normal position of FIG. 4, overlying the panel 12. With the snap fastener 35 opened, the opening B$^1$ in FIG. 10 is formed by the mother grasping the panel 12A in the area of the snap fastener portions 35$^1$ and 35$^2$ and pulling those portions of the snap fastener away from each other in the directions of the double arrow in FIG. 10.

When nursing is finished the mother can close the opening B$^1$ and cover the breast with the panel 12A by reconnecting the two parts of the snap fastener 35 within the privacy provided by the flap 13$^1$.

The portion of the panel 12A beneath the flap 13, on the left side of the garment in FIG. 10, is opened and closed in the same manner, when desired.

Figure 8:
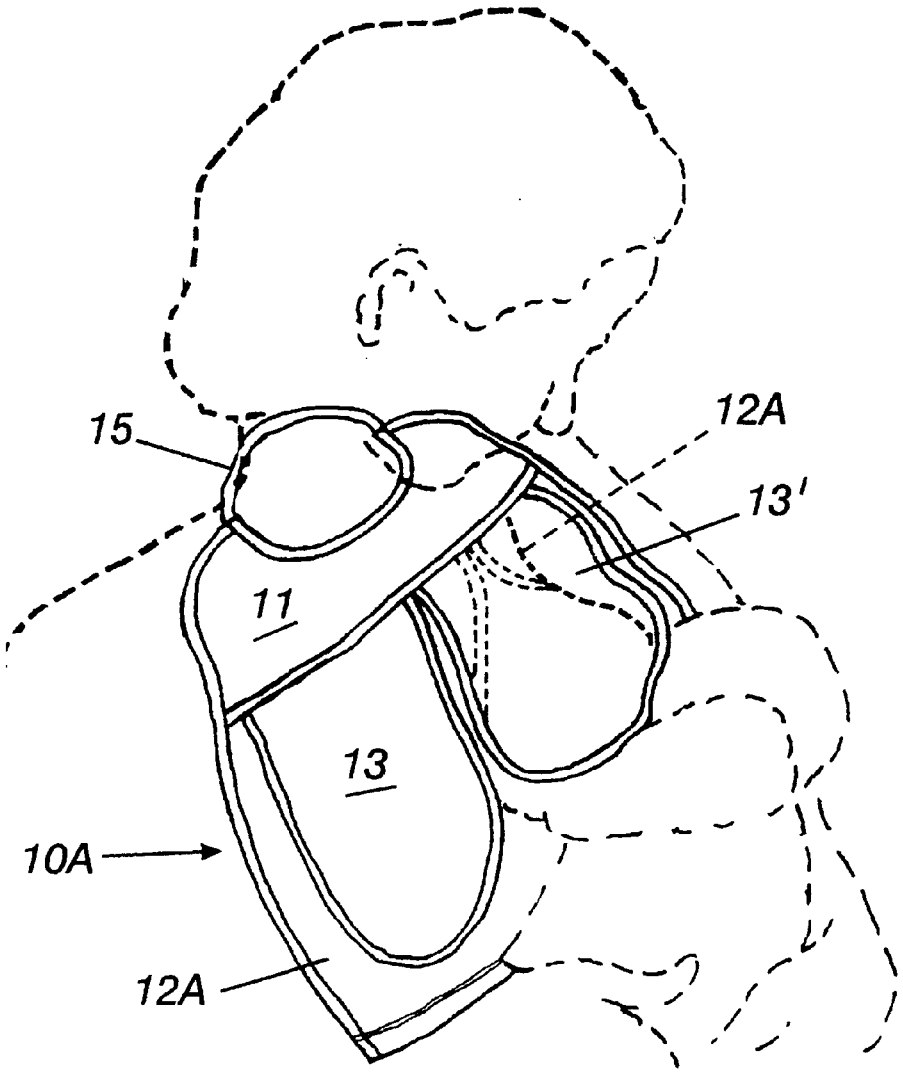
FIG. 8 is a perspective view showing the bib of FIG. 4 being used by a mother while nursing her child, the mother and child being shown in dotted lines.

FIG. 8 illustrates the privacy provided by the flap 13$^1$ while the panel 12A is open and a mother is nursing her baby.

The shaded areas 50, in both embodiments of the invention, represent the user's choice of embroidery. It is not part of the invention and may be used as desired.

The nursing bib of this invention is designed for use with conventional outerwear, but its utility is not so limited. The nursing garment is user friendly and can be satisfactorily used in the environment of the user's choice.

There is thus provided a nursing bib with two layers of protection for the privacy a mother seeks when nursing her baby in public. The panel normally covers the breasts and provides some privacy even when the panel is open for nursing. The overlying flap shields the mother's breast before, during, and after nursing, and also shields the mother's manipulation of the panel to form an opening for nursing and to close the opening after nursing. After nursing, the loop 15 can be easily removed from the user's neck and the bib packed with the rest of the baby's paraphernalia until it is needed again.

I claim:

1. A nursing bib intended to be worn over a mother's outerwear only for nursing her baby in public, said bib comprising:

A) a body portion to extend only across the chest and shoulders and above the breasts of the mother;

i) the body portion including a curved neckline and the body portion extending from the curved neckline to downwardly extending sides of the body portion and the sides diverging from each other as they extend to the bottom of the body portion;

B) a loop extending between the ends of said curved neckline, whereby the mother may quickly and easily pass the loop over her head and around her neck to quickly position the bib over the upper portion of her outerwear;

C) a panel extending downwardly from the body portion to cover the mother's breasts;

i) the panel having two vertical openings positioned to overlie the mother's breasts;

D) closure means associated with the openings in the panel overlying the mother's breasts whereby the mother may manually close each opening to cover the underlying breast and may manually open each opening for nursing;

E) a pair of planar flaps extending downwardly from the body portion beyond the breasts and in overlying relation to the openings in the panel, whereby the breasts are additionally covered for nursing; and F) said bib being of a size that is small enough to be carried with the baby's paraphernalia between uses and large enough to fit comfortably over the upper portion of the mother's outerwear for use.

2. The invention of claim 1 wherein the vertical openings positioned to overlie the mother's breasts are defined by two separate but adjoining portions of the panel over each breast and wherein the adjoining portions of the panel overlying the breasts include means to distinguish one of the breasts from the other.

3. The invention of claim 2 wherein said means to distinguish one vertical opening from the other are closure means of different colors.

4. The invention of claim 3 wherein the closure means are snap fasteners.

5. A nursing bib comprising a body portion that will extend only across a mother's chest above her breasts, a loop extending from the top of the body portion, whereby the bib may be quickly suspended from the mother's neck, a panel fixed to the bottom of the body portion at the ends of the body portion and at a point mid-way between the ends of the body portion, the panel being positioned to overlie the mother's breasts, means releasably connecting the top of the panel to the body portion at points between the fixed connections at the ends of the body portion and the fixed connection midway the ends of the body portion, and a planar flap extending freely downwardly from the body portion in overlying relation to the panel, whereby additional cover is provided for the breasts during nursing.

6. The invention of claim 5 wherein a second planar flap extends freely downwardly from the body portion to provide a separate flap and additional cover for each breast during nursing.

* * * * *